United States Patent [19]

Kelley

[11] Patent Number: 4,589,454

[45] Date of Patent: May 20, 1986

[54] VALVE BAG FILLING CONDUIT

[75] Inventor: Robert G. Kelley, South Jordan, Utah

[73] Assignee: Champion International Corporation, Stamford, Conn.

[21] Appl. No.: 710,369

[22] Filed: Mar. 11, 1985

[51] Int. Cl.[4] ..... B65B 3/04

[52] U.S. Cl. ..... 141/68; 141/89; 141/114; 141/313; 141/392; 137/240; 137/244; 251/61.1; 239/591; 239/451; 366/18

[58] Field of Search ..... 141/10, 67, 68, 89-92, 141/114, 313-317, 392; 13.7/240, 244; 251/61.1; 406/45, 193; 239/591, 451, 455, 106; 366/18, 19, 69

[56] References Cited

U.S. PATENT DOCUMENTS

| | | | |
|---|---|---|---|
| 2,399,712 | 5/1946 | Sowerwine | 239/106 |
| 2,671,692 | 3/1954 | Matirko | 239/591 |
| 2,793,080 | 5/1957 | Brown et al. | 239/591 |
| 2,874,925 | 2/1959 | Stafford | 251/61.1 |
| 3,001,828 | 9/1961 | Stadtlaender | 406/45 |

*Primary Examiner*—Houston S. Bell, Jr.
*Attorney, Agent, or Firm*—Evelyn M. Sommer

[57] ABSTRACT

A filling machine for packaging divided solid material having a conduit for feeding the material under pressure into a packaging container, wherein an elastic liner is disposed in and extends along a part of the length of the conduit, has its opposite ends secured to the conduit, and cooperates with the inner surface of the conduit to form a cavity. The conduit is formed with a vent opening to the cavity to permit outward expansion of the liner when material is flowing through the conduit and inward contraction of the liner when there is no flow through the conduit, thereby flexing the liner to crack and break off material adhering to the inner surface of the liner.

7 Claims, 6 Drawing Figures

VALVE BAG FILLING CONDUIT

BACKGROUND OF THE INVENTION

This invention relates to a valve bag filling machine and, more particularly, to an improved spout for a valve bag filling machine.

A machine of the class described is exemplified in U.S. Pat. No. 3,261,379 ('379) which discloses a bin for fluidizing the material to be packaged and a conduit including a filling spout for conducting the material to a bag which is secured to the spout to receive a charge of the material. The bag is weighed and the flow of material is cut off when a predetermined weight is reached by pinching a flexible tube forming a portion of the conduit through which the fluidized material moves from the bin to the filling spout.

Certain materials, such as titanium dioxide and other pigments, tend to build up on the inside of the filling spout as they pass through the spout to the bag. This type of material when in motion is prone to stick to any rigid surface it strikes. As such material passes under pressure through the filling spout it randomly strikes the inner surface of the filling spout and gradually builds up layer upon layer. Most of these pigments have a tendency to build up to a point where they become unstable. In such case material may break off after a certain thickness has accumulated. This can cause bag weight errors due to either or both of the following:

1. The actual weight of a filled bag is influenced by the amount of material that flows into a bag after a balance condition in the scale is reached. This is due to the fact that the material flow cutoff device takes time to react to the scale stop command. The amount of extra material that flows from the time of command to the time all flow stops is directly proportional to the rate of material flow during this time. If buildup is heavy while a bag is being filled, the flow rate is small. So the amount of extra material is small. However, if a chunk of the built-up material breaks away during the beginning portions of the next bag fill cycle, the next bag will have a higher flow rate. So the amount of extra material will be larger. The difference between the weight of the extra amount of material entering the first bag and the weight of the extra material entering the next bag is the bag weight error.

2. By convenience of design, the filling spout that delivers material to a bag is normally mounted on the weighing device. Therefore, any material buildup in the filling spout is sensed by the scale. As a bag being filled approaches its desired weight, all the material on the scale is sensed by the scale. This includes the buildup of material in the filling spout, as well as the material in the bag. However, when the bag is removed from the filling spout and placed on an independent floor scale to check its weight, the material buildup inside the filling spout, which is sensed by the weighing device associated with the filling spout, is not part of the weight sensed by the floor scale. The filled bag weighs less by an amount equal to the buildup in the filling spout. As buildup in the filling spout increases and decreases, that is, breaks away, it causes a proportional increase and decrease in the filled bag weight. This is the bag weight error.

With the new computer weigh systems developed for valve bag filling machines, bag weight accuracy requirements are more stringent. In addition to the bag weight error problems described above, a new problem has surfaced with computer weigh systems. Such a system has the ability to make a weight correction based on the error detected on a previously filled bag. When the computer senses a bag weight error, it makes an adjustment to bring the next bag weight closer to the desired bag weight. It senses the bag weight while the bag is still on the filling spout.

The problem encountered with self-adjusting computer weigh systems is similar to the second problem discussed above in connection with conventional weigh systems. The computer reads the just-filled bag weight while it is still on the scale associated with the filling spout. At this point the computer senses the weight of the material in the bag and the weight of the material buildup in the filling spout. The actual filled weight of the bag, as checked on an independent floor scale, is different from the computer reading by the amount of material buildup in the filling tube. Again, as this buildup varies so does the error between the actual filled bag weight and the computer reading of that bag. So the computer makes adjustments based on erroneous data. This causes even greater variation in bag weight error.

The only practical solution to all the problems described above is to reduce to a negligible amount, or eliminate entirely, the buildup of material in the filling spout.

SUMMARY OF THE INVENTION

The foregoing problems are overcome, in accordance with the present invention, by special provisions for the introduction of material into the valve bag. The invention is directed to a filling machine for packaging divided solid material having a conduit for feeding the material under pressure into a packaging container, wherein an elastic liner is disposed in and extends along a part of the length of the conduit, has its opposite ends secured to the conduit, and cooperates with the conduit to form a cavity. The conduit is formed with a vent opening to the cavity to permit expansion of the liner when material is flowing through the conduit and contraction of the liner when there is no flow through the conduit, thereby flexing the liner to crack and break off material adhering to the inner surface of the liner.

DESCRIPTION OF THE PREFERRED EMBODIMENT

For a detailed explanation of packaging machines of the class described and in connection with which the present invention finds application, attention is again invited to U.S. Pat. No. 3,261,379.

Figure 1:
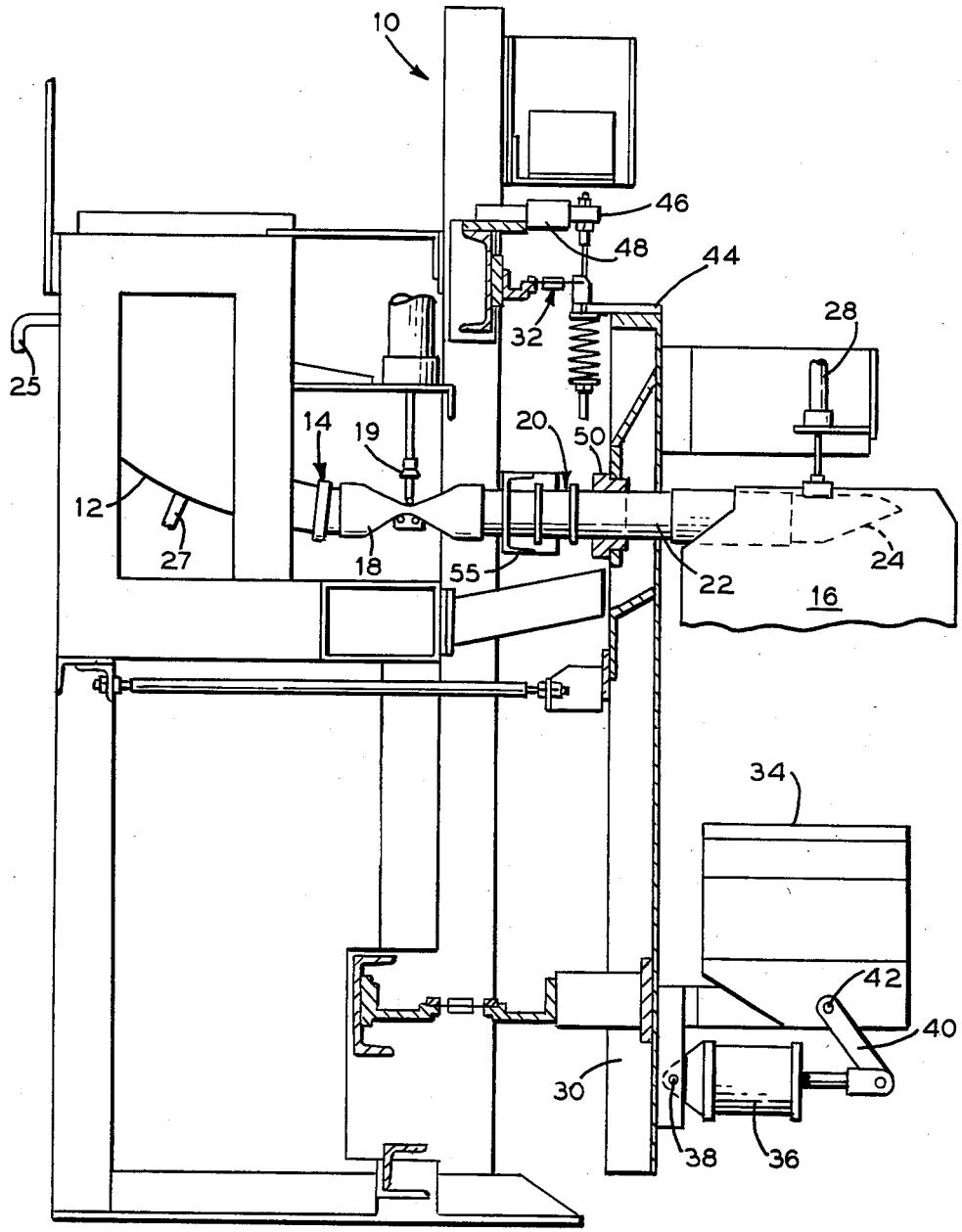
FIG. 1 is a schematic assembly view illustrating a packaging machine embodying the invention.
Figure 2:
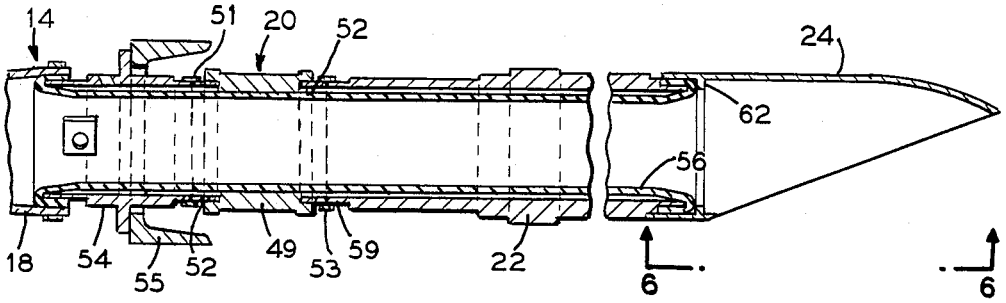
FIG. 2 is an enlarged view of the conduit for feeding material into the packaging container.

Referring to FIG. 1, there is shown a frame 10 which supports a material bin 12 having an outlet connected by a conduit 14 for flow of material to a valve bag 16. Conduit 14 includes a flexible sleeve or pinch tube 18, an isolation device 20, a filling spout 22 and a nozzle 24. Pinch tube 18 may be squeezed shut to stop the flow of material through conduit 14 by a cutoff device 19 of known construction. Low pressure high volume air, admitted to bin 12 through pipes 25 and 27, drives the material through conduit 14 and helps it to flow more freely and uniformly, thereby increasing fill accuracy.

A pneumatically operable clamp assembly 28 of a known type is mounted above nozzle 24 to engage bag 16 in the region of its valve and to clamp the valve against the nozzle to maintain the valve around at least a portion of the nozzle so that material may flow through the nozzle into the bag.

A bag chair post 30 is supported from the machine frame for controlled movement by a force balancing system 32 which does not constitute a part of the present invention and need not be described here in detail. Suffice it to say that chair post 30 supports a bag chair 34 for seating a bag during filling. Such seating arrangements are also well-known in the art so that it is necessary here only to mention that chair 34 may be tilted by operation of a pneumatic ram 36 pivoted as at 38 to post 30. The piston rod of ram 36 is pivoted to a crank arm 40 which is fixed to the bag seat at 42 to tilt chair 34 so as to discharge a filled bag from nozzle 24.

The filled condition of the bag is determined by its weight and, for this purpose, chair post 30 is connected by a suitable bracket 44 to a load measuring device 46 which includes a load cell 48 conveniently mounted on frame 10. A micro-computer, not shown, responds to the load cell and controls the pinch tube cutoff device 19 so that the bag is filled to a predetermined weight. Also, after device 19 is cut off and while the bag is still on the filling spout, the micro-computer displays the filled bag weight.

Filling spout 22 is secured to bag chair post 30 by a suitable clamp 50 and isolation device 20 is interposed in the material flow path between the entrance end of filling spout 22 and pinch tube 18.

Isolation device 20 is of the type disclosed in U.S. patent application Ser. No. 509,766, the disclosure of which is herein incorporated by reference. It includes a flexible tube 49 of rubber or the like having metal rings 52 vulcanized to its ends, with upstream ring 52 abutting and secured by a clamp 51 to one end of a tubular member 54 and downstream ring 52 abutting and secured by a clamp 53 to an annular extension 59 of filling spout 22 and with the opposite end of member 54 being secured to pinch tube 18. Member 54 extends through a channel-shaped element 55 with which it constitutes an isolation bracket. Isolation device 20 is constructed and arranged so that it is positively fixed in position to eliminate the possibility of forces caused by shifting thereof to adversely affect the weighing section of the machine.

Figure 3:
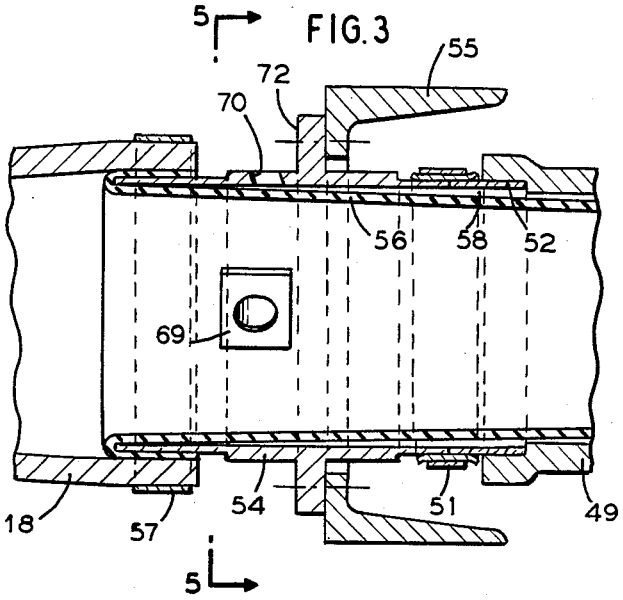
FIGS. 3 and 4 are enlarged sectional views of portions of the structure illustrated in FIG. 2.
Figure 4:
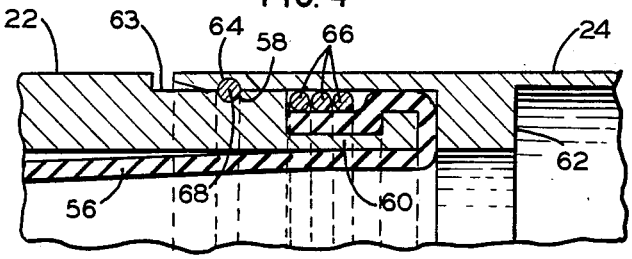

According to the present invention and as illustrated in FIGS. 3 and 4, conduit 14 is provided with an internal elastic liner 56 of rubber or the like. Liner 56 extends along a portion of the length of and has its opposite ends secured in a pneumatically tight manner to conduit 14 and cooperates with conduit 14 to form a cavity 58. More particularly, the inlet end of tubular member 54 is disposed inside of the outlet end of pinch tube 18, with the inlet end of liner 56 being reversely bent and overlapping the outer surface of member 54 and disposed between pinch tube 18 and member 54, and with a clamp 57 cooperating with pinch tube 18 and member 54 to fasten the inlet end of liner 56.

Member 54 has its wall formed with a vent 70 opening to cavity 58 and its outer surface formed with an outwardly projecting annular flange 72 fastened to the outer surface of the web of channel 55.

The outlet end of spout 22 is formed with an annular extension 63 which has its outer surface formed with annular grooves 58 and 60. The entrance portion of nozzle 24 has its inner surface formed with an inwardly projecting annular flange 62 and an annular groove 64. Liner 56 has its outlet end reversely bent for securement in groove 60 by wire ties 66, while nozzle 24 is secured to filling spout 22 by locking wire 68, seated in grooves 58 and 64, with flange 62 cooperating with spout 22 to further secure the outlet end of liner 22. Preferably, the outside diameter of the liner should be $\frac{1}{8}''$ to $\frac{1}{4}''$ smaller than the inside diameter of spout 22.

When the material flows from bin 12 through conduit 14 into bag 16, it is propelled by the positive pressure in bin 12. This pressure is transmitted to the inside of liner 56. Since the inside of the liner is at a higher pressure than the outside of the liner when material is flowing through conduit 14, because air in cavity discharges through vent 70, the liner expands outwardly until it contacts the inner surface of spout 22. This pressure differential is maintained during the filling cycle of the bag. Meanwhile the liner is rigid and material buildup occurs. When the bag reaches its desired weight and material flow is cut off, the internal pressure of conduit 14 decays back to atmospheric. This allows liner 56 to contract back to its original shape. The expansion and contraction causes any material buildup on the liner during the bag fill cycle to crack and break off. An air jet device 69 located at the entrance of liner 56 is used to convey the loosened buildup flakes out of the liner and into the bag.

Thus at the end of each bag filling cycle any buildup of material that occurs during a cycle is loosened and flushed out of liner 56. This effectively eliminates the problem of material buildup inside the lined portion of conduit 14.

Figure 6:
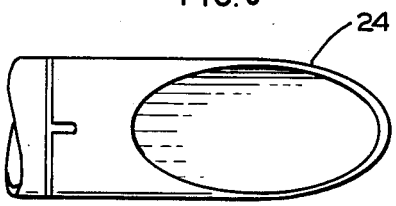
FIG. 6 is a plan view taken along line 6—6 of FIG. 4.
Figure 5:
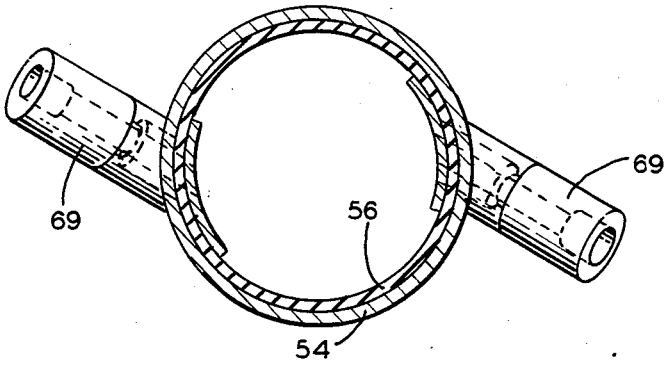
FIG. 5 is a sectional view taken along line 5—5 of FIG. 3.

As shown, the downstream end of liner is located at the discharge end of spout 22. This leaves nozzle 24 unlined and subject to buildup of material. The irregular shape of the nozzle makes it difficult to apply a liner. The problem is easily solved in some installations by eliminating the nozzle. Otherwise, the problem is overcome by reducing the area of the nozzle tip by cutting a hole in it, as shown in FIG. 6 This could also be accomplished by fabricating a wire grid tip. In either case, the rigid surface that remains is small enough so that the weight error caused by tip buildup is negligible.

While liner 56 preferably covers all the rigid inside surfaces of the material flow conduit that is part of the weighing system, it can be extended to cover the entire conduit. Although it is preferred to vent cavity 58 to the atmosphere to permit expansion of liner 56 when material is flowing through conduit 14, alternatively vent 70 may be utilized to introduce air into cavity 58 and to maintain it at a pressure less than the pressure in conduit 14 when material is flowing through the conduit so that the liner will expand outwardly with flow and contract with no flow, thereby flexing the liner to crack and break off material adhering to the inner surface of the liner.

I claim:

1. In a filling machine for packaging divided solid material having a conduit, and means feeding the material under pressure through the conduit into a packaging container, the improvement which comprises an elastic liner in the conduit extending along a part of the length of and having its opposite ends secured to the conduit and cooperating with the inner surface of the conduit to form a cavity, and means for outwardly expanding the liner when material is flowing through the conduit and inwardly contracting the liner when there is no flow through the conduit, thereby flexing the liner to crack and break up material adhering to the inner surface of the liner.

2. In a filling machine for packaging divided solid material having a conduit, and means feeding the material under pressure through the conduit into a packaging container, the improvement which comprises an elastic liner in the conduit extending along a part of the length of and having its opposite ends secured to the conduit and cooperating with the conduit to form a cavity, and means including a vent formed in the conduit and opening to the cavity for outwardly expanding the liner into contact with the inner surface of the conduit when material is flowing through the conduit and inwardly contracting the liner when there is no flow of material through the conduit, thereby flexing the liner to crack and break off material adhering to the inner surface of the liner.

3. The filling machine of claim 2, wherein the conduit includes a filling spout, and the elastic liner extends along the full length of the spout.

4. The filling machine of claim 3, wherein the conduit includes a nozzle connected to the spout and discharging to the container, and the tip of the nozzle is formed with an opening to minimize the buildup of material on the inner surface of the nozzle.

5. The filling machine of claim 2, wherein the conduit includes a filling spout and a nozzle opening to the container, the elastic liner has its outlet end reversely bent and secured to the outer surface of the outlet end of the spout, and the nozzle is connected to the outlet end of the spout and cooperates with the spout to hold the outlet end of the liner in place.

6. The filling machine of claim 5 wherein the conduit includes a flexible sleeve and a tubular member, the inlet end of the liner is reversely bent and overlaps the outer surface of the inlet end of the tubular member, and the inlet end of the tubular member is connected to the outlet end of the flexible sleeve and cooperates with the flexible sleeve to hold the inlet end of the liner in place.

7. The filling machine of claim 6, wherein an air jet device is located at the inlet end of the liner to convey the broken up material out of the liner and into the container.

* * * * *